United States Patent [19]

Ueda

[11] 4,120,760

[45] Oct. 17, 1978

[54] SURFACE TREATMENT OF METALS

[75] Inventor: Kenji Ueda, Nagasaki, Japan

[73] Assignee: Mitsubishi Jukogyo Kabushiki Kaisha, Tokyo, Japan

[21] Appl. No.: 662,418

[22] Filed: Mar. 1, 1976

[30] Foreign Application Priority Data

Mar. 20, 1975 [JP] Japan ..... 50-33604

[51] Int. Cl.[2] ..... C25D 3/22; C25D 7/00; C23F 14/00; C23F 15/00

[52] U.S. Cl. ..... 204/55 R; 204/147

[58] Field of Search ..... 204/55 R, 147

[56] References Cited

U.S. PATENT DOCUMENTS

| | | | |
|---|---|---|---|
| 921,641 | 5/1909 | Cumberland | 204/147 |
| 1,012,665 | 12/1911 | Lemetre | 204/55 R |
| 2,965,551 | 12/1960 | Richaud | 204/32 |
| 3,470,074 | 9/1969 | Schick | 204/55 R |

*Primary Examiner*—F.C. Edmundson

[57] ABSTRACT

In forming a protective coating of zinc on metal surface of iron, steel, copper or the like, a neutral solution containing a zinc compound is deoxidized and, making the metal immersed therein or in contact therewith the cathode of a cell, a current is passed therethrough to cause deposition of zinc on the metal surface. The metal to be protected may, for example, be in the form of a metal structure, as a ballast tank or condenser of a ship.

8 Claims, 3 Drawing Figures

SURFACE TREATMENT OF METALS

This invention relates to improvements in surface treatment of metals, and more specifically to a method for coating large metal structures of iron, steel, copper or the like with zinc and thereby providing good corrosion resistance to the metal surfaces.

Usually protection of metal surfaces against corrosive attacks is obtained by applying paints or other coating materials on the surfaces or by plating the same. For structures of considerable sizes, however, the coating is often very costly and plating requires equipment too large to be practical. For these reasons it is customary that such a huge structure as the ballast tank or condenser of a ship be subjected to cathodic protection by which the structure itself is made the cathode of a system and a current is passed therethrough. A drawback of the cathodic protection is that it fails to achieve a protective effect when the ballast tank or condenser is not full of the solution through which the current is to flow. Therefore, how to prevent the corrosion of the empty ballast tank has been an important problem. In an effort to settle this, it has been proposed to pass a current of high density through the structure in a filled state so that the magnesium and calcium contents of sea water undergo the following reactions (1) and (2):

$$Mg^{++} + 20H^- \rightarrow Mg(OH) \downarrow \quad (1)$$

$$Ca^{++} + HCO_3^- + OH^- \rightarrow CaCO_3 \downarrow + H_2O \quad (2)$$

The $Mg(OH)_2$ and $CaCO_3$ thus produced are deposited on the inner surfaces of the tank to afford a protective coating which prevents the corrosion of the vessel during the empty periods. However, the method that depends on the metal hydroxide and the like for the protective coating has inherent disadvantages of peeling and cracking due to the growth of coated film and distortional forces of waves and those resulting from cargo handling operation, with consequent reduction of the anticorrosive effect.

In addition, the thick electrocoating layer (of the magnesium hydroxide and calcium carbonate) thus deposited on the surfaces of the metal structure has such poor adhesion that it easily comes off from the steel surface, and the droppings settle on the bottom and form sludge, leading to irregular corrosion of the bottom. Moreover, this necessitates cleaning for sludge removal.

The present invention results from a thorough study of the possibility of circumventing the foregoing difficulties. It is thus directed to a novel method for treating the surfaces of metals by coating them with zinc so as to provide improved corrosion resistance to metal structures even when the structures are not filled with liquid and when they are subject to corrosion by stress or stress variation. The method, when applied to metal structures filled with sea water, will inhibit the growth of the aforementioned electrocoating layer and thereby prevent the settling of sludge on the bottoms of the structures.

According to the present invention sea water, which is normally corrosive is caused first to absorb a sulfite gas which is then caused to react with the oxygen in the water so that substantially all of the dissolved oxygen therein is freed. The sea water freed of such oxygen is then employed as the electrolyte in a galvanic cell in which the metal to be treated is the cathode.

One specific form of, the invention resides in a method for surface treatment of metals which comprises deoxidizing a zinccontaining neutral solution, immersing a metal, such as iron or copper, of a nobler potential than zinc in the solution, and passing a current through the metal as the cathode, thereby coating the metal surface with zinc. In another form the anode of the galvanic cell is zinc.

In the method of the invention the solution freed of dissolved oxygen is employed for the reason now to be explained. The graph in FIG. 1 shows the relationship between the current and potential observed when a current was passed through a cell in which a metal such as iron was the cathode. The curve *a* was drawn when the neutral solution contained dissolved oxygen, and the curve *b* when the solution was free of the dissolved oxygen. The curve *c* represents the zinc diffusion current. Thus, when there is dissolved oxygen in the solution, hydroxide ions evolve prior to the deposition of zinc as expressed by the formula (3):

$$O_2 + 2H_2O + 4e^- \rightarrow 4OH^- \quad (3)$$

The hydroxide ions then cover the metal surface and make the deposition of metallic zinc difficult. Particularly when calcium, magnesium and other such hard ingredients are present in the aqueous solution, they form deposits of their hydroxides and carbonates and hamper the deposition of zinc as follows:

$$\left.\begin{array}{l} Ca^{++} + 2OH^- \rightarrow Ca(OH)_2 \downarrow \\ Mg^{++} + 2OH^- \rightarrow Mg(OH)_2 \downarrow \\ Ca^{++} + OH^- + HCO^{3-} \rightarrow CaCO_3 \downarrow + H_2O \\ Zn^{++} + 2OH^- \rightarrow Zn(OH)_2 \downarrow \end{array}\right\} \quad (4)$$

In the method of the invention where there is no dissolved oxygen, the reaction of the formula (3) above does not take place, and therefore, in the absence of hydroxide ions and hard constituents, the reaction of the following formula (5) proceeds:

$$Zn^{++} + 2e \rightarrow Zn \quad (5)$$

As a consequence, the metal surface is coated with metallic zinc.

Once the deposition of metallic zinc starts in this way, the hydrogen overvoltage will increase, inhibiting the evolution of $OH^-$ and facilitating the zinc deposition, until the metal surface is satisfactorily coated with the zinc.

Other aspects, objects, and advantages of the invention will appear more fully from the following description and the appended drawings showing preferred embodiments of system for carrying out the method of the invention.

Figure 1:
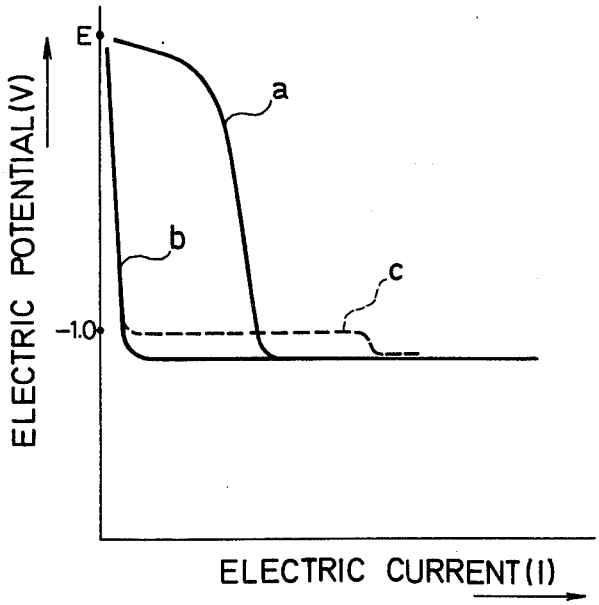
FIG. 1 is a graph showing the relationship between the potential and current established when iron or the like in a neutral solution was made the cathode of a cell and a current was passed through the cell.
Figure 2:
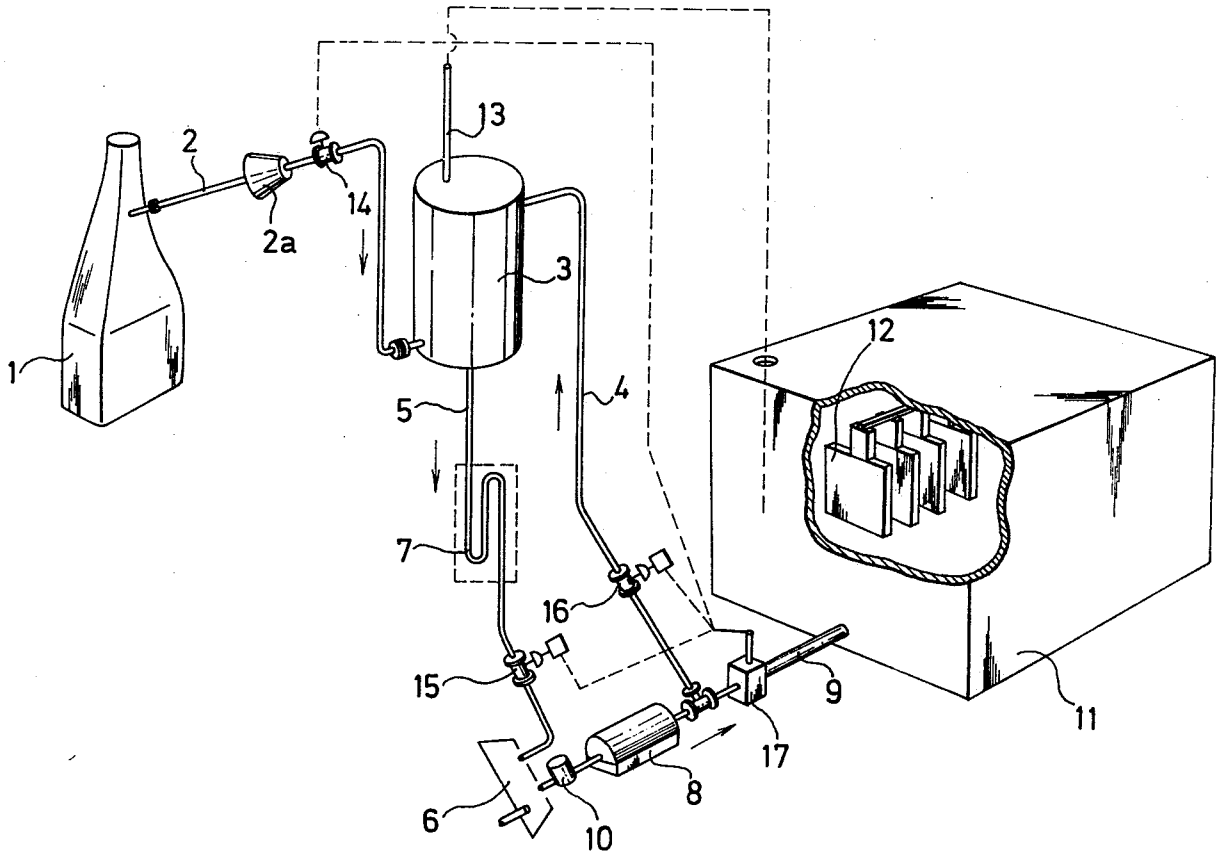
FIG. 2 is a perspective view of an embodiment of system for carrying out the method of the invention.

Referring now to FIG. 2, there is shown a system for carrying out the method of the invention as applied to a typical ballast tank of a ship. A combustion apparatus, generally indicated at 1, is a boiler or engine, for example, which burns sulfur-containing fuel. The combustion gases from the apparatus 1 are drawn through a suction device 2a installed on a gas line 2 into a gas absorber 3. On the other hand, sea water is introduced from a sea line 4 into the gas absorber 3, where it selectively absorbs sulfur dioxide from the combustion products and dissolves it to the form of sulfurous acid.

The sea water thus containing the sulfurous acid is released from the gas absorber 3 to a sea intake 6 via a drain line 5 provided with a backflow-preventing trap 7. At the sea intake 6 fresh sea water being taken in is mixed with the liquid being released through the drain line 5, and the mixture is drawn into a sea line 9 by means of a pump 8. The sea line 9 includes, midway between the sea intake 6 and the pump 8, a reaction accelerating device 10 containing a catalytic metal, e.g., copper, cobalt, or an alloy of such a metal, which accelerates the reaction between sulfurous acid and dissolved oxygen in sea water to remove the dissolved oxygen. The sea line 9 is connected to the above-mentioned line 4 for the supply of sea water into the gas absorber 3.

In the manner described, the sea water freed of dissolved oxygen flows down through the line 9 into a ballast tank 11. When the tank 11 has been filled up, the inner walls of the vessel and a plurality of zinc anodes 12 held within, and electrically connected to, the tank combinedly form a galvanic cell. A current then flows between the zinc anodes 12 and the ballast tank 11, producing zinc ions and forming a protective coating of metallic zinc on the inner surface of the tank 11. Alternatively, the tank 11 may contain zinc ions in advance so that a good zinc coating may be rapidly formed. In the latter case, a zinc ion amount of more than $10^{-4}$mol/l will couple with the current density (100 mA/m$^2$) usually employed for cathodic protection to provide a satisfactory protective coating of zinc. Where an external source is utilized for power supply, control of the current will be easier and a better coating will result. This, when performed in accordance with the invention, will involve no danger of the hydrogen evolution along the cathode surface that has been a problem yet to be solved for commercial acceptance of the procedure.

The remainder of the combustion gases left in the gas absorber 3 has a low oxygen concentration and can be supplied to the unfilled space of the tank 11 by way of a gas line 13.

Other components of the system include control valves 14, 15, 16 for controlling, respectively, the amount of combustion gases to be released, the amount of liquid to be drained from the gas absorber 3, and the amount of liquid to be supplied to the absorber, and a detector 17 of a conventional design for detecting the concentration of dissolved oxygen in the sea water within the sea line 9, or the oxidation-reduction potential equivalent thereto or the pH of the sea water. Signals from this detector 17 actuate the control valves 14, 15, 16 for the respective control actions.

Thus, the method of the invention when applied to the ballast tanks of ships would preclude the corrosion of the inner walls even if the tanks were emptied.

Chartering market conditions may sometimes force ships to lie idle at their moorings for prolonged periods of time. In such an event, the protective coating in accordance with the present invention proves advantageous in that it precludes the formation of electrocoating layer (of magnesium hydroxide and calcium carbonate) and consumes less zinc anodes than in the prior art because the current consumption is not more than about one-fifth of that in the conventional process with a solution containing dissolved oxygen. With the ballast tanks of ships a common practice has been to decrease the quantity of protective zinc according to the period in which the tanks are filled with sea water, or according to the ballast rate, in consideration of the relation between the cargo weight and ballast. In case of extended detention of the ships, however, the ballast rate can reach 100%, necessitating means for accommodating accordingly additional zinc anodes. The method of the invention, by contrast, eliminates this disadvantage by removing dissolved oxygen from the neutral solution and thereby markedly reducing the zinc consumption. The method is very advantageously applicable to the ships which have been operative as well. In this case, for added efficiency in the removal of dissolved oxygen, the system shown in FIG. 2 may incorporate means for sealing a mass of gas or gaseous mixture having a low oxygen concentration hermetically within the upper space of the tank to avoid dissolution of air into the deoxidized sea water. As a further alternative, the arrangement may be combined with the use of a deoxidizing agent, such as sodium sulfite, a seal in the upper space of the tank, or of means for allowing an oil, antirust fluid or the like to float over the water surface in the vessel.

Figure 3:
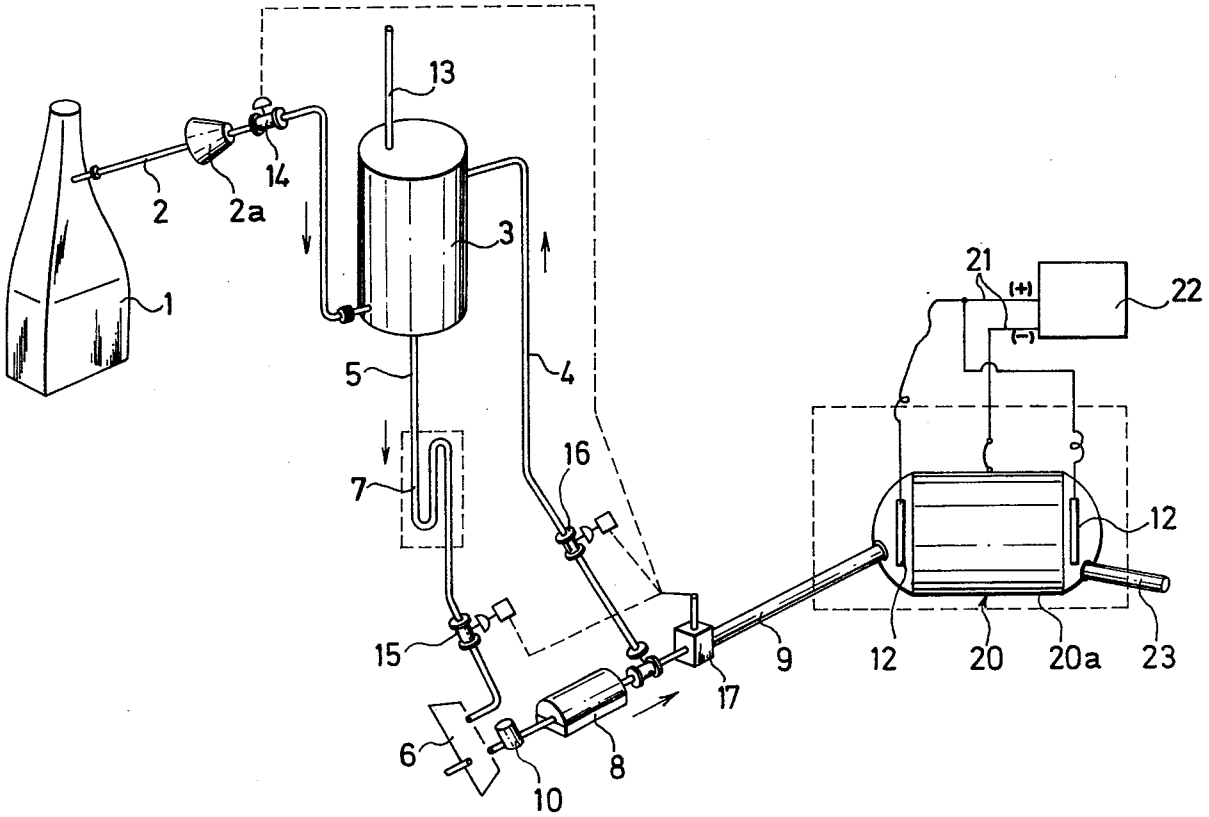
FIG. 3 is a perspective view of another embodiment of system for practicing the method of the invention.

Another example of the method according to the invention as applied to the protecting of a condenser will be described below in connection with FIG. 3. Combustion gases from a combustion apparatus 1 are conducted to a gas absorber 3, where they are dissolved as sulfurous acid into sea water. The liquid in which the sulfurous acid is dissolved is joined with a fresh supply of sea water in a sea intake 6, and is forced together by a pump 8 to a reaction accelerating device 10, where it reacts with dissolved oxygen in the sea water to remove the same. The sea water thus freed of dissolved oxygen flows into a condenser 20 and cools steam or other liquid therein.

In order to provide corrosion resistance to the condenser 20, zinc anodes 12 held within the condenser and the surrounding wall 20a of the condenser as the cathode are connected by lead wires 21 to an external source 22 so that a current is passed between the zinc anodes 12 and the condenser 20 and a zinc coating is formed on the inner surface of the condenser. Numeral 23 designates a sea drain line.

As stated, the method of the invention when resorted to for cathodic protection of a condenser will accomplish zinc coating of the entire inner surface of the vessel with an excellent protective effect. There is no possibility of its heat transfer effect being reduced by the deposition of $Mg(OH)_2$, $CaCO_3$ and the like on the inner surface as is the case with the prior art coating, and the condenser performance is kept unaffected.

While the method of the invention has been described as utilizing combustion gases and dissolving sulfur dioxide contained in the combustion gases in the form of sulfurous acid and then using the acid as a reducing agent for the removal of dissolved oxygen, it is possible instead to install a separate feeder for such a reducing agent. Another alternative to the use of combustion gases might include the provision of means for blowing nitrogen, argon or other inert gas into sea water within the tank or condenser to drive off dissolved oxygen from the water. Further, hydrazine or the like may be adopted as the reducing agent to react with the dissolved oxygen. The supply of zinc ions to the metal structure, such as a tank or condenser, may alternatively be accomplished by a zinc ion feeder to be incorporated in the system. It will also be readily understood by those skilled in the art that the metal of the structure to be protected in accordance with the invention is not limited to iron but may be copper or the like.

As above described, the method according to the invention comprises placing a metal of a nobler potential than zinc into a neutral solution which contains zinc ions and is free of dissolved oxygen, and passing a current through the cell in which the metal forms the cathode, thereby coating the metal surface with zinc. Thus, when applied to the protection of large metal structures the method will provide good corrosion resistance; even if the structures are not filled with sea water they are subjected to repeated stress.

What is claimed is:

1. A method for imparting corrosion resistance to the surface of a metal body having a potential nobler than that of zinc coming into contact with sea water, comprising the steps of contacting said sea water with a sulfur dioxide-containing gas under conditions such that sulfurous acid is formed and reacts with the dissolved oxygen in said sea water to free said sea water of substantially all of said dissolved oxygen, contacting said sea water freed of dissolved oxygen with the surface of the metal body and forming with an anode a galvanic cell in which the said metal body is the cathode and the seawater freed of oxygen is the electrolyte, at least one of said anode and electrolyte containing zinc, said galvanic cell acting to coat said metal body with zinc without an accompanying deposition or crystallization of the hydroxide and carbonate constituents of said sea water.

2. The method according to claim 1, wherein at least a portion of said sea water is passed into contact with the combustion gases of a fuel containing sulfur to form sulfurous acid gas therein.

3. The method according to claim 2, whereing said sulfurous acid-containing sea water is provided with a catalytic metal to accelerate the reaction between the sulfurous acid and the dissolved oxygen in the sea water.

4. The method according to claim 3 wherein said catalytic metal is selected from the group consisting of copper, cobalt and alloys thereof.

5. The method according to claim 1 wherein said sea water contains a zinc compound, and said anode is formed of a metal having a potential nobler than that of zinc.

6. The method according to claim 5, wherein said nobler metal is selected from the group consisting of iron, copper and alloys thereof.

7. The method according to claim 1, wherein said anode is formed of zinc.

8. The method according to claim 7, wherein said sea water contains zinc ions.

* * * * *